US005845520A

United States Patent [19]

Dolev

[11] Patent Number: 5,845,520

[45] Date of Patent: Dec. 8, 1998

[54] LOCKS AND HASPS

[76] Inventor: Moshe Dolev, 4 Hamlacha Street, Raanana, Israel, 43100

[21] Appl. No.: 842,715

[22] Filed: Apr. 16, 1997

[51] Int. Cl.[6] ..... E05B 67/32

[52] U.S. Cl. ..... 70/37; 70/54; 70/232; 70/2

[58] Field of Search ..... 292/281–286; 70/37, 54–56, 2–12, 158–178, 232

[56] References Cited

U.S. PATENT DOCUMENTS

| | | | |
|---|---|---|---|
| 574,755 | 1/1897 | Oehler | 70/DIG. 58 X |
| 683,286 | 9/1901 | Houser | 70/37 |
| 1,829,444 | 10/1931 | Goebel et al. | 70/DIG. 58 X |
| 2,845,295 | 7/1958 | Clarke | 292/281 |
| 3,245,240 | 4/1966 | Deforrest | 70/DIG. 58 X |
| 3,460,861 | 8/1969 | Nilola | 292/281 |
| 3,744,280 | 7/1973 | Brown, Jr. et al. | 70/54 |
| 3,901,056 | 8/1975 | Coolidge | 70/19 |
| 3,996,774 | 12/1976 | Best | 70/54 X |
| 4,269,048 | 5/1981 | McDorman | 70/2 X |
| 4,300,373 | 11/1981 | Camos et al. | 70/178 X |
| 4,405,161 | 9/1983 | Young et al. | 70/232 X |
| 4,745,783 | 5/1988 | Poe | 70/2 |
| 4,777,811 | 10/1988 | Binkley et al. | 70/232 X |
| 4,949,560 | 8/1990 | Anderson | 70/2 |
| 5,033,280 | 7/1991 | Johnson | 70/232 |
| 5,174,135 | 12/1992 | Loughlin | 70/2 |
| 5,590,682 | 1/1997 | Fischer | 70/178 X |
| 5,609,049 | 3/1997 | Rundle et al. | 70/167 X |
| 5,669,255 | 9/1997 | Albano | 70/381 X |

*Primary Examiner*—Suzanne Dino Barrett
*Attorney, Agent, or Firm*—Darby & Darby

[57] ABSTRACT

A padlock for maintaining at least two hasps in engagement, including a two-part metal housing including first and second housing portions which are mutually hinged together so as to be pivotable between a mutually open orientation and a mutually closed orientation and a key-operated locking mechanism for selectably locking the first and second housing portions in the mutually closed orientation, the first and second housing portions each including hasp enclosing portions which are operative when the first and second housing portions are in the mutually closed orientation to maintain the hasps in engagement and to prevent disengagement of the first and second housing portions therefrom and when the first and second housing portions are in the mutually open orientation to permit disengagement of the first and second housing portions from the hasps and to allow the hasps to be disengaged.

21 Claims, 8 Drawing Sheets

LOCKS AND HASPS

FIELD OF THE INVENTION

The present invention relates to locks and hasps generally and more particularly key operated locks, such as padlocks, for maintaining multiple elements in a predetermined mutual arrangement and to hasps useful therewith.

BACKGROUND OF THE INVENTION

A great variety of key operated locks are known in the art for maintaining multiple elements in a predetermined mutual arrangement. These include many types of padlocks which generally include a locking element arranged to pass through and thus lockingly engage two or more apertured members or hasps.

Conventional padlocks consist of three principal parts, a lock housing, a locking mechanism located in the lock housing and a locking element, such as a shackle or locking pin.

Conventional hasps are apertured members through which the locking element extends.

A disadvantage of conventional padlocks and hasps is that they may often be defeated by forceful twisting of the locking element about the hasps, cutting or sawing through the locking element. In conventional padlocks, the locking element and the hasps are generally exposed.

SUMMARY OF THE INVENTION

The present invention seeks to provide a novel lock and hasps which have a decreased susceptibility to defeat by forced twisting.

There is thus provided in accordance with a preferred embodiment of the present invention a padlock for maintaining at least two hasps in engagement, including:

a two-part metal housing including first and second housing portions which are mutually hinged together so as to be pivotable between a mutually open orientation and a mutually closed orientation and a key-operated locking mechanism for selectably locking the first and second housing portions in the mutually closed orientation, the first and second housing portions each including hasp enclosing portions which are operative:

when the first and second housing portions are in the mutually closed orientation to maintain the hasps in engagement and to prevent disengagement of the first and second housing portions therefrom; and when the first and second housing portions are in the mutually open orientation to permit disengagement of the first and second housing portions from the hasps and to allow the hasps to be disengaged.

Preferably, engagement of the hasp enclosing portions with the hasps is such that the first and second housing portions in the mutually closed orientation may be rotated about the lockable elements in multiple planes without disengagement therefrom or damage to the first and second housing portions.

In accordance with one embodiment of the present invention, the hasp enclosing portions have internally directed protrusions which engage suitable sockets formed in the hasps and thus prevent rotation of the first and second housing portions in the mutually closed orientation about the hasps.

In this embodiment, preferably the hasp enclosing portions together define a rectangular opening to accommodate the hasps.

Preferably, the hasp enclosing portions each have at least one mutually engaging toothed edge surface.

In accordance with a preferred embodiment of the present invention, the key-operated locking mechanism for selectably locking the first and second housing portions in the mutually closed orientation includes a key-operated lock cylinder.

Preferably, the key-operated lock cylinder is located along an axis which is offset from a hinge axis about which the first and second housing portions are mutually rotatable.

In accordance with a preferred embodiment of the present invention, the key-operated lock cylinder operates a cam which, when the first and second housing portions are in the mutually closed orientation is positionable by the lock cylinder in an orientation which prevents rotation of the first and second housing portions out of the mutually closed orientation.

Preferably, the hasp enclosing portions are located on an opposite side of the hinge axis from the lock cylinder.

In accordance with a preferred embodiment of the present invention, the first and second housing portions are configured such that when they are in the mutually closed orientation, their outer configuration generally defines first and second mutually fused spheres, one of the spheres including the hasp enclosing portions and the other of the spheres including the hinge axis and the lock cylinder.

There is also provided in accordance with a preferred embodiment of the present invention a lock for maintaining at least two lockable elements in a predetermined mutual arrangement, including first and second locking members which are mutually hinged together so as to be pivotable between a mutually open orientation and a mutually closed orientation and a key-operated locking mechanism for selectably locking the first and second locking members in the mutually closed orientation, the first and second locking members each including lockable element enclosing portions which are operative:

when the first and second locking members are in the mutually closed orientation to maintain the lockable elements in the predetermined mutual arrangement and to prevent disengagement of the first and second locking members therefrom; and when the first and second locking members are in the mutually open orientation to permit disengagement of the first and second locking members from the lockable elements and to release the lockable elements from predetermined mutual arrangement.

In accordance with a preferred embodiment of the present invention, the engagement of the lockable element enclosing portions with the lockable elements is such that the first and second locking members in the mutually closed orientation may be rotated about the lockable elements in at least one plane and preferably in multiple planes without disengagement therefrom or damage to the first and second locking members.

Alternatively, the lockable element enclosing portions may have internally directed protrusions which engage suitable sockets formed in the lockable elements and thus prevent rotation of the first and second locking members in the mutually closed orientation about the lockable elements. This embodiment is particularly suitable for use with conventional apertured hasps.

In accordance with a preferred embodiment of the present invention the lockable element enclosing portions each have at least one mutually engaging toothed edge surface.

Preferably, the key-operated lock cylinder operates a cam which, when the first and second locking members are in the mutually closed orientation is positionable by the lock cylinder in an orientation which prevents rotation of the first and second locking members out of the mutually closed orientation.

In accordance with a preferred embodiment of the present invention the lockable element enclosing portions are located on an opposite side of the hinge axis from the lock cylinder.

It is a particular feature of the present invention that it encloses and thus protects the hasps. In this way, it greatly increases locking security.

The configuration of the lock of the present invention is such that the minimum cross section presented by the lock is substantially greater than the cross section of a corresponding conventional locking element such as a shackle of a conventional padlock. This is achieved in the present invention substantially without adding either volume or weight to the lock.

Additionally in accordance with a preferred embodiment of the present invention there is provided a hasp for use with a padlock for maintaining at least two hasps in engagement, comprising:

a two-part metal housing including first and second housing portions which are mutually hinged together so as to be pivotable between a mutually open orientation and a mutually closed orientation and a key-operated locking mechanism for selectably locking the first and second housing portions in the mutually closed orientation, the first and second housing portions each including hasp enclosing portions which are operative:

when the first and second housing portions are in the mutually closed orientation to maintain the hasps in engagement and to prevent disengagement of the first and second housing portions therefrom; and when the first and second housing portions are in the mutually open orientation to permit disengagement of the first and second housing portions from the hasps and to allow the hasps to be disengaged, the hasp being characterized in that is configured as a solid of rotation.

Preferably, the hasp is hemispherical. In accordance with a preferred embodiment of the invention, the hasp is further characterized in that it is unapertured.

There is also provided in accordance with a preferred embodiment of the present invention a hasp for use with a padlock for maintaining at least two hasps in engagement, comprising:

a two-part metal housing including first and second housing portions which are mutually hinged together so as to be pivotable between a mutually open orientation and a mutually closed orientation and a key-operated locking mechanism for selectably locking the first and second housing portions in the mutually closed orientation, the first and second housing portions each including hasp enclosing portions which are operative:

when the first and second housing portions are in the mutually closed orientation to maintain the hasps in engagement and to prevent disengagement of the first and second housing portions therefrom; and when the first and second housing portions are in the mutually open orientation to permit disengagement of the first and second housing portions from the hasps and to allow the hasps to be disengaged, the hasp being characterized in that is unapertured.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 12:
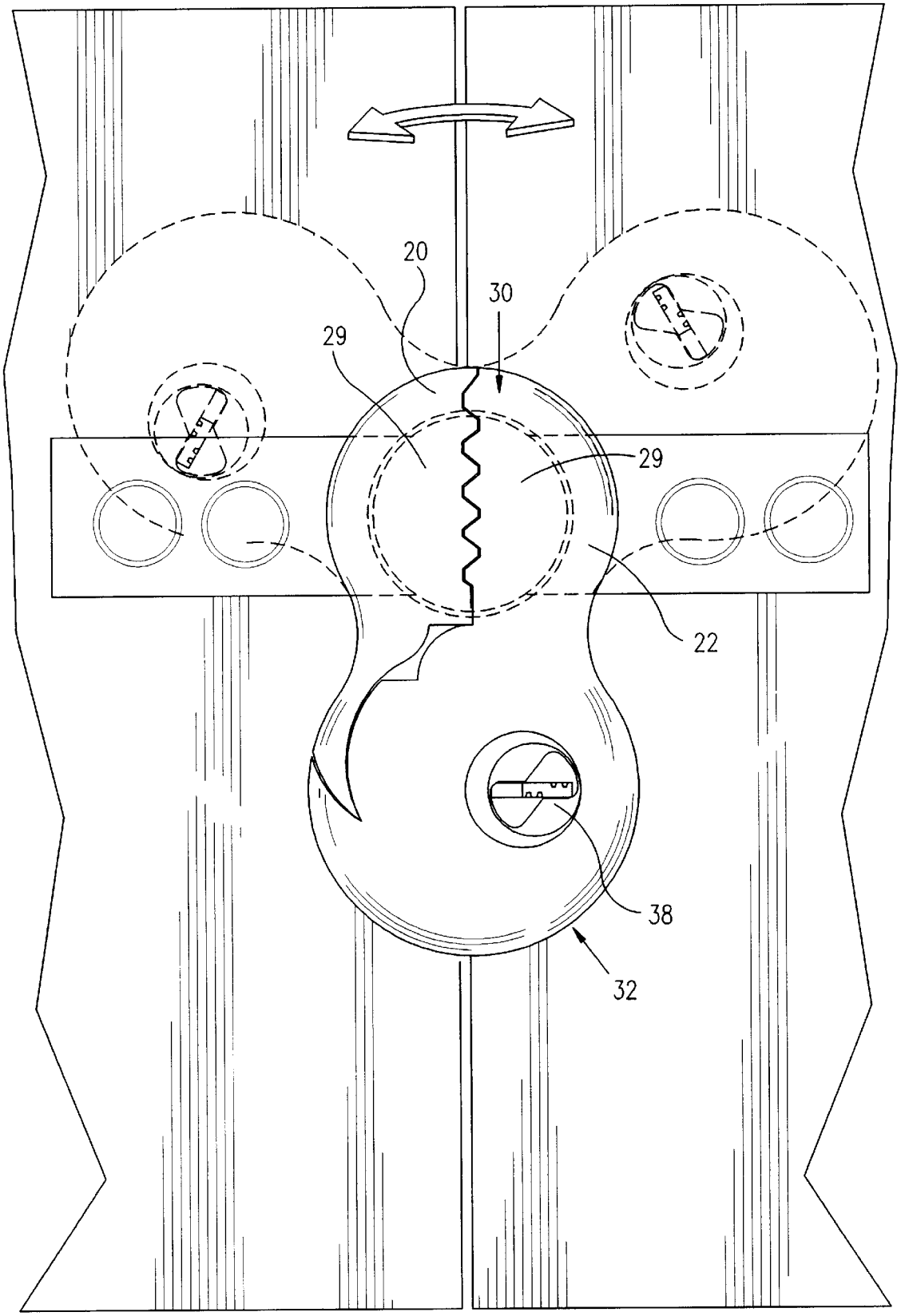
FIG. 12 is a pictorial illustration of the rotatability of the lock of FIGS. 1–8 about the lockable elements.
Figure 13:
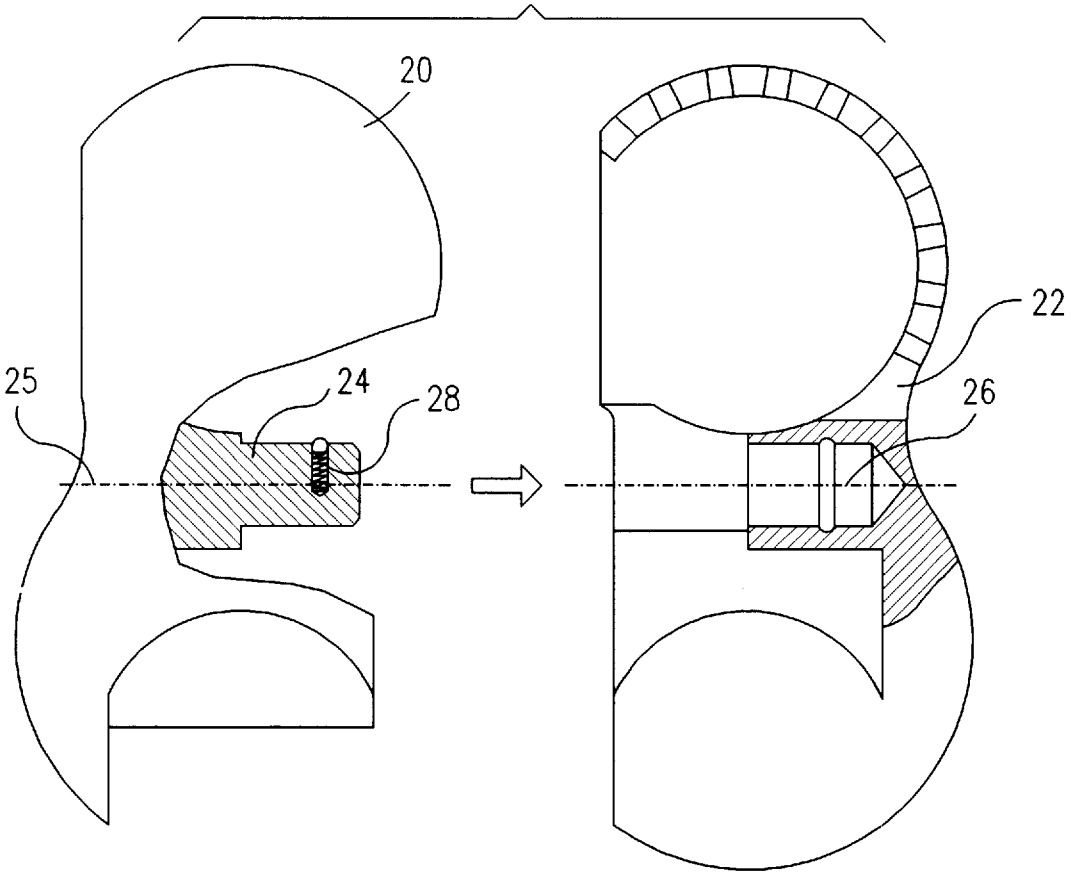
FIG. 13 is a partially cut-away illustration of the hinged engagement of the first and second locking members forming the lock of the present invention.

Reference is now made to FIGS. 1–8, 12 and 13, which illustrate a lock constructed and operative in accordance with a preferred embodiment of the present invention. The lock preferably comprises first and second locking members or housing portions 20 and 22 which are hinged together preferably by means of a hinge axle 24, arranged along a hinge axis 25, and which is retained in a hinge axle socket 26 as by means of a spring loaded retaining element 28 (FIG. 13).

The first and second locking members 20 and 22 are arranged for locking engagement with first and second lockable elements 29, which are preferably generally hemispherical elements, as shown, but may be hasps of any suitable type.

In accordance with a preferred embodiment of the present invention, the lockable elements 29 constitute novel hasps having two independently novel characteristics in that they are define solids of revolution and that they are not apertured. In the preferred embodiment of the invention shown in FIGS. 1–7, the hasps are show to be spherical.

When in a closed orientation, as shown in FIGS. 2, 4, 5, 7 and 8, the lock has an overall outer configuration of a pair of fused spheres 30 and 32, sphere 30 including lockable element enclosing portions 34 and 36, also termed hasp enclosing portions, of respective locking members 20 and 22 and sphere 32 including the hinge axis 25 and a lock cylinder 38.

It is a particular feature of the present invention that it encloses and thus protects the hasps. In this way, it greatly increases locking security.

The configuration of the lock of the present invention is such that the minimum cross section presented by the lock is substantially greater than the cross section of a corresponding conventional locking element such as a shackle of a conventional padlock. This is achieved in the present invention substantially without adding either volume or weight to the lock.

Hasp enclosing portions 34 and 36 preferably have cooperatively toothed edges 40 and 42 which are mutually engaged when the lock is in a closed orientation. The teeth are preferably radially directed so as not to be separable by axial movement parallel to axis 25 when engaged. The toothed configuration also provides protection against forced insertion of a breakage tool therebetween.

Lockable element enclosing portions 34 and 36 also preferably define mutually facing cut outs 44 and 46 which cooperate to define an opening to the interior thereof, which is a generally spherical volume.

In accordance with a preferred embodiment of the present invention, lock cylinder 38 is a key-operated lock cylinder and is preferably located along an axis 60 which is offset from the hinge axis 25 about which the first and second locking members 20 and 22 are mutually rotatable. Alternatively, lock cylinder 38 may be located along any other suitable axis, such as an axis perpendicular to axis 25.

Figure 2:
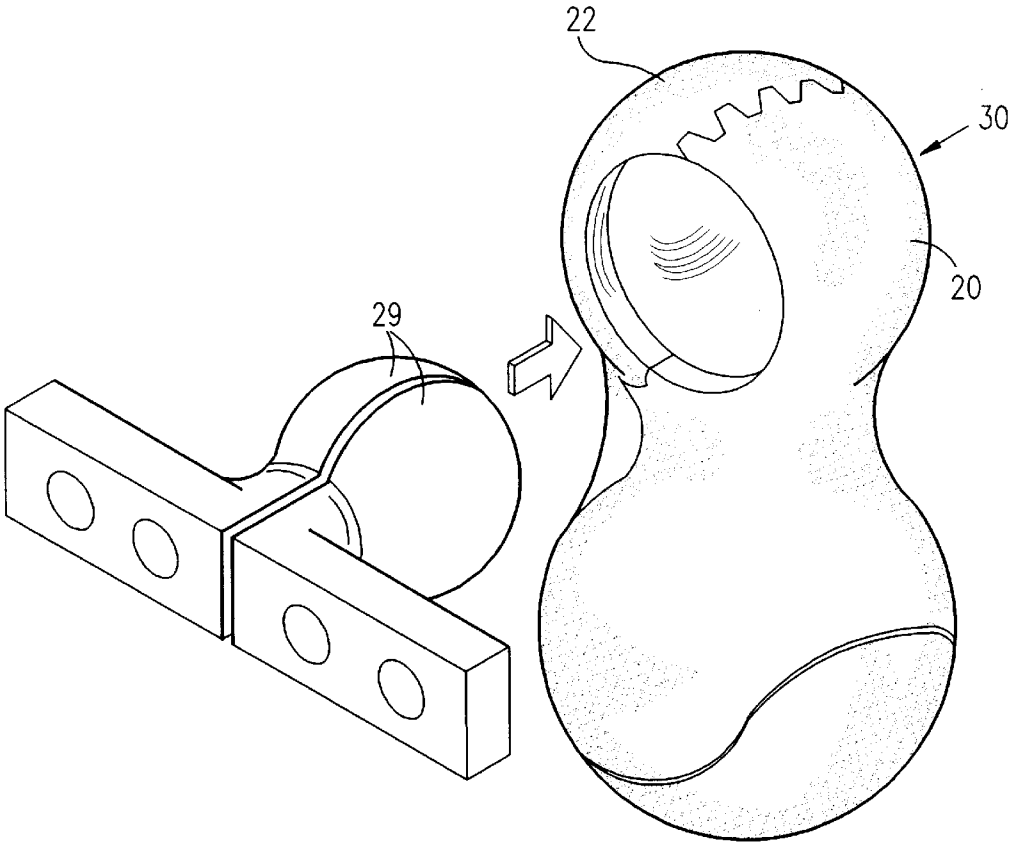
FIG. 1 and FIG. 2 are simplified pictorial illustrations of a preferred embodiment of a lock and hasp constructed and operative in accordance with a preferred embodiment of the present invention in respective open and closed orientations.
Figure 1:
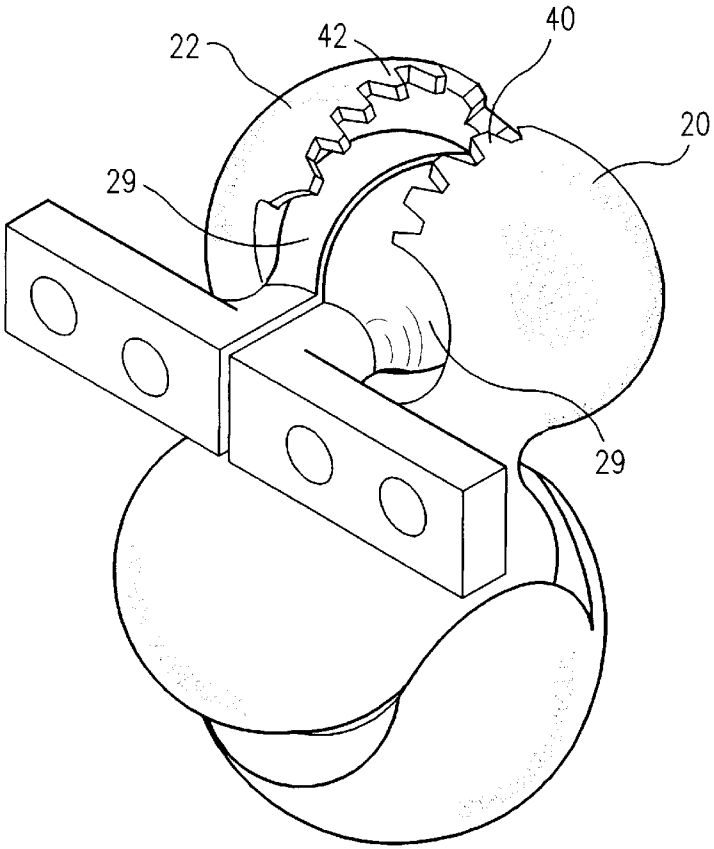
Figure 5:
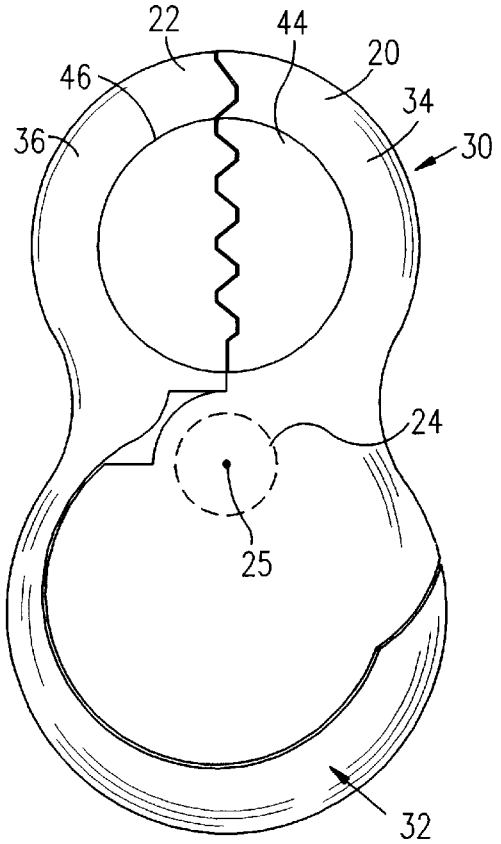
FIG. 4 and FIG. 5 are respective front and back view illustrations corresponding to FIG. 12 illustrating the hinge axis.
Figure 4:
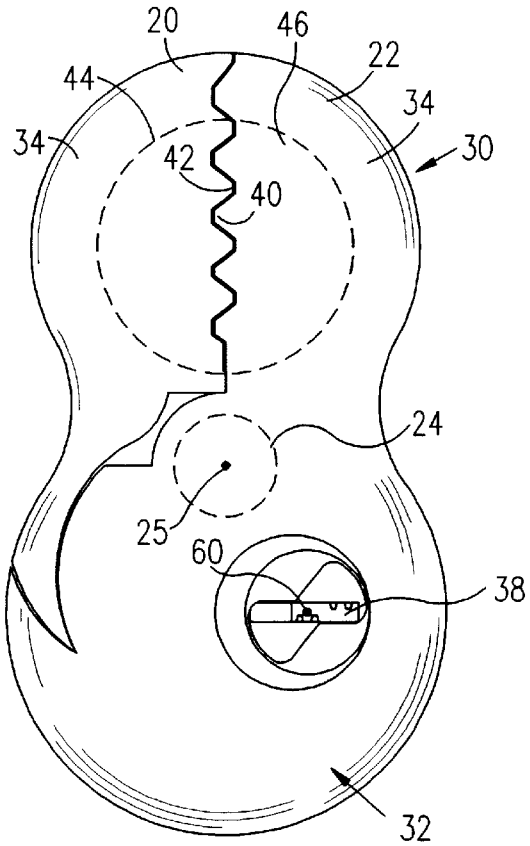
Figure 3:
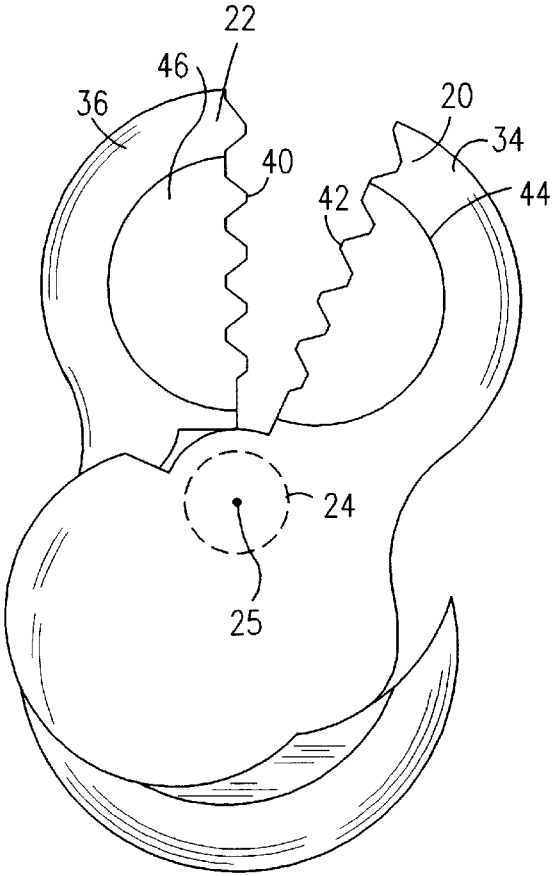
FIG. 3 is a back view illustration corresponding to FIG. 1, illustrating the hinge axis.
Figure 7:
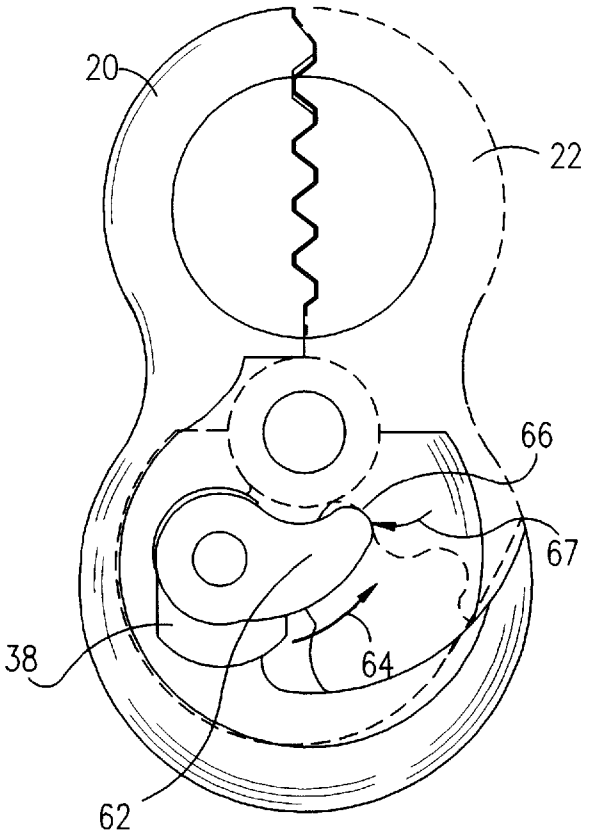
FIG. 6 and FIG. 7 are illustrations corresponding to FIG. 3 and FIG. 5, illustrating operation of the lock cylinder operated cam for locking and unlocking the first and second locking members.
Figure 6:
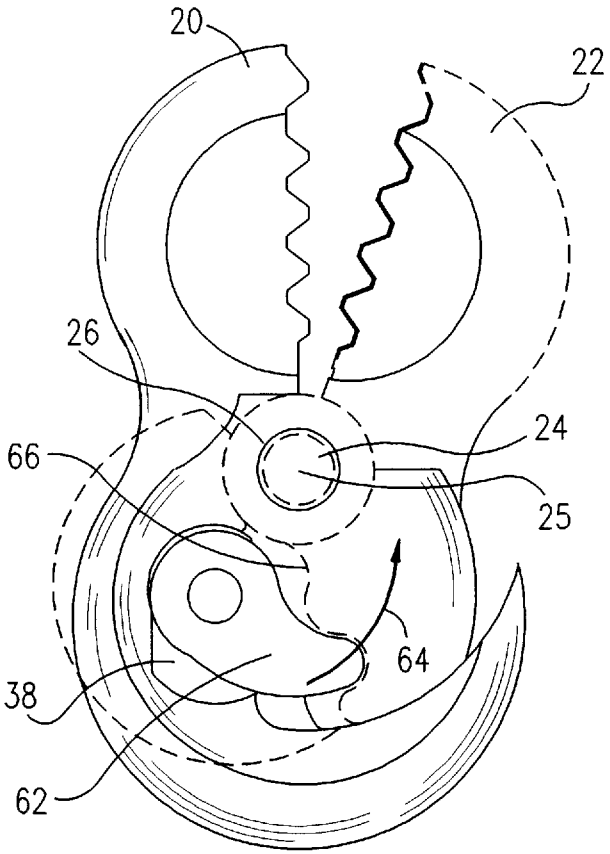

Referring particularly to FIGS. 6 and 7, it is seen that preferably, the key-operated lock cylinder 38 operates a cam 62. In accordance with a preferred embodiment of the invention, only when the first and second locking members 20 and 22 are in the mutually closed orientation as shown in FIG. 7, is the cam 62 positionable by the lock cylinder 38 in an orientation which prevents rotation of the first and second locking members out of the mutually closed orientation.

It may be seen from a consideration of FIGS. 6 and 7 that when the first and second locking members 20 and 22 are in a mutually open orientation, as shown in FIG. 6, rotation of cam 62 in the direction indicated by an arrow 64, is operative to bring the first and second locking members 20 and 22 into the mutually closed orientation, shown in FIG. 7.

When the first and second locking members 20 and 22 are rotated to a mutually closed orientation as shown in FIG. 7, rotation of the cam 62 in the direction indicated by arrow 64, locates the cam 62 in engagement with a surface recess 66 defined by locking member 22, which prevents opening of the lock, thus locking the first and second locking members 20 and 22 in the mutually closed orientation shown in FIG. 7.

It is a particular feature of the invention that rotation of cam 62 into locking engagement as shown in FIG. 7, produces an over-center rotation of cam 62 and thus provides a dead-locking feature, whereby when cam 62 is in its locked engagement against surface recess 66, attempts to force the lock open by applying pressure along an arrow 67, will not move cam 62 from its locking engagement.

Figure 8:
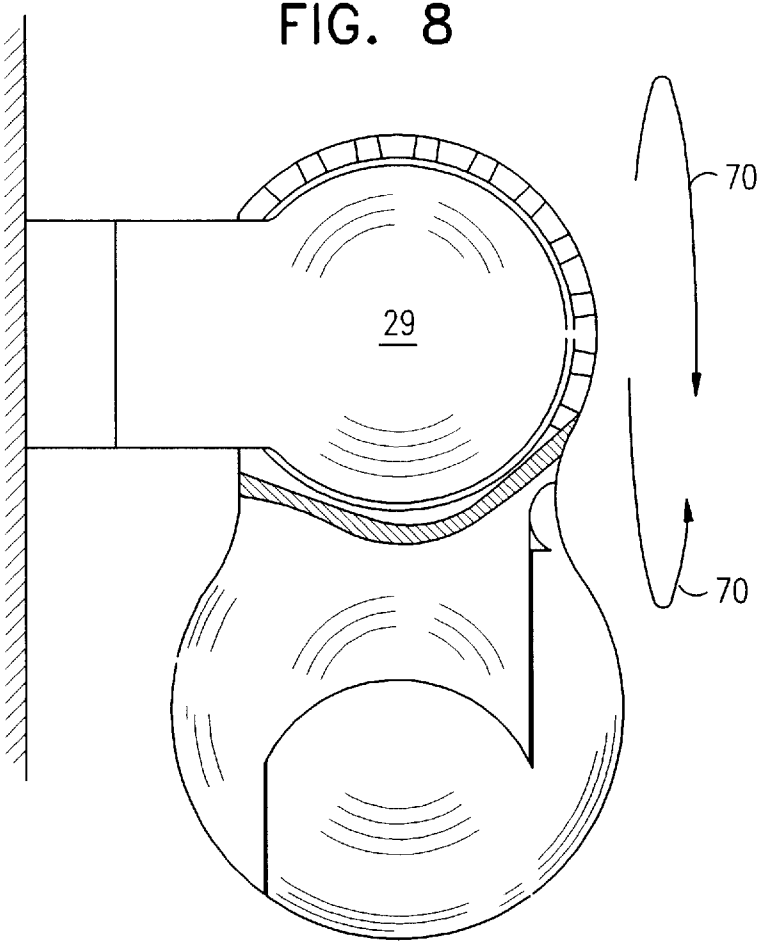
FIG. 8 is a partially cut away side view illustration of the lock of FIGS. 1–7 in locking engagement with a pair of lockable elements.

Referring now to FIG. 8, it is noted that the lock can freely pivot in directions indicated by arrows 70 about lockable elements 29. FIG. 12 illustrates the relatively free rotatability of the lock of FIGS. 1–8 about the sphere defined by the predetermined mutual arrangement of lockable elements 29.

Figure 9:
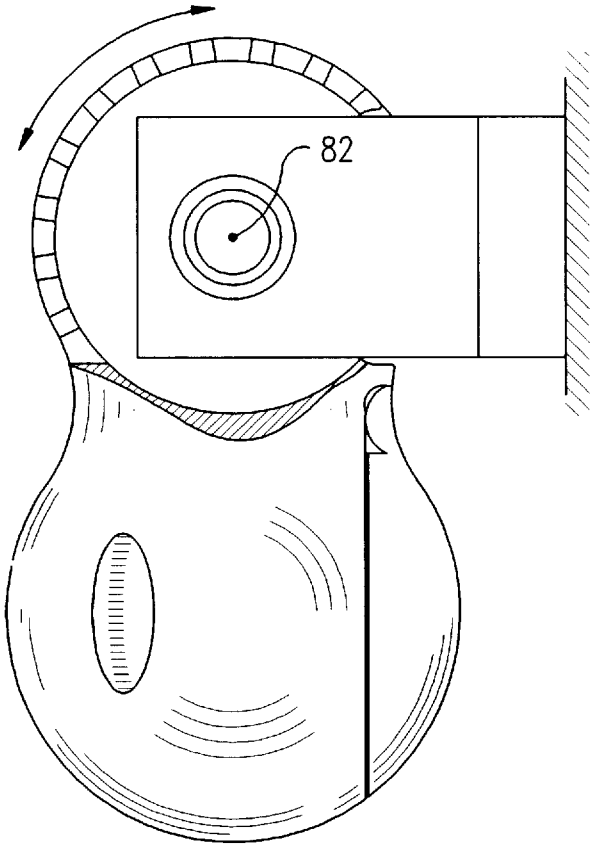
FIG. 9 is a partially cut away side view illustration of another embodiment of lock in an orientation similar to that shown in FIG. 8.
Figure 11:
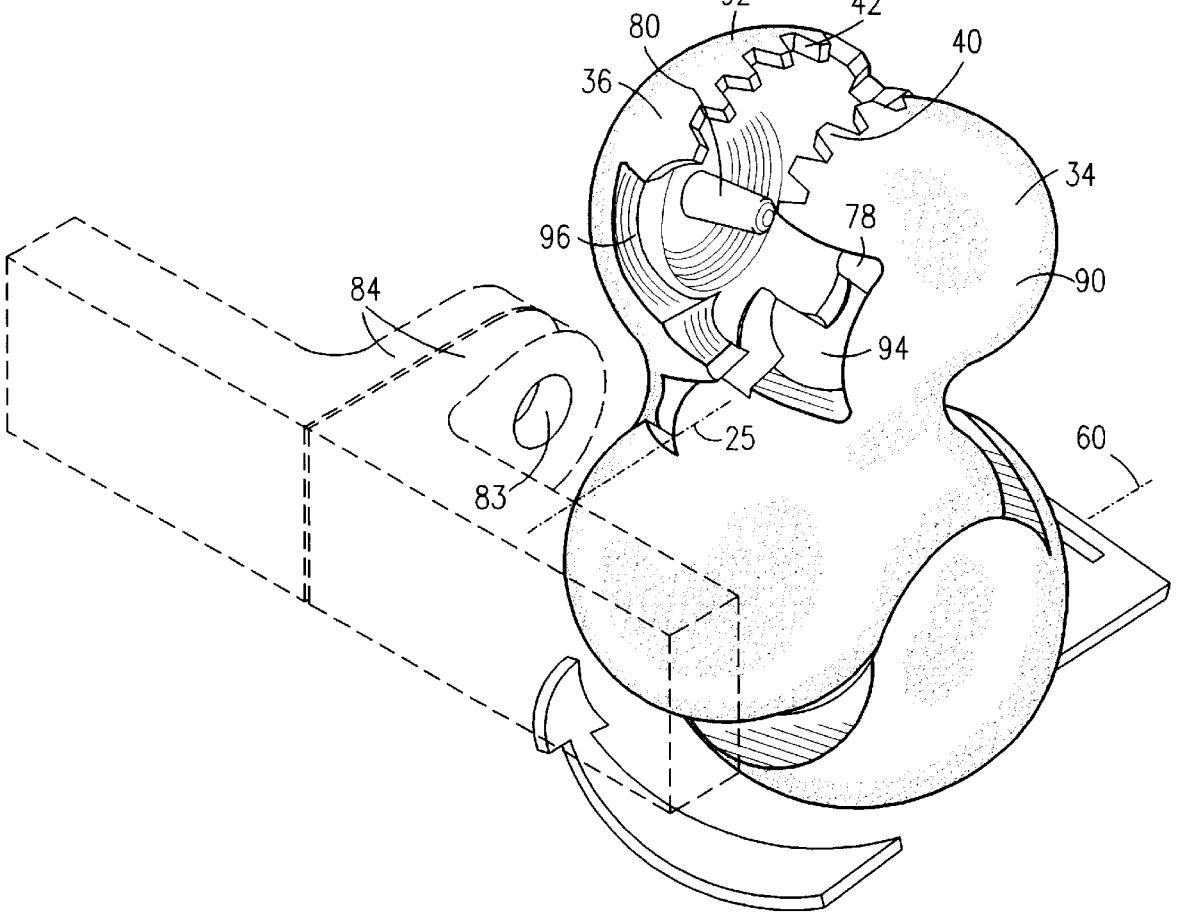
FIG. 10 and FIG. 11 are pictorial illustrations of the lock of FIG. 9 in respective mutually closed and open engagement.
Figure 10:
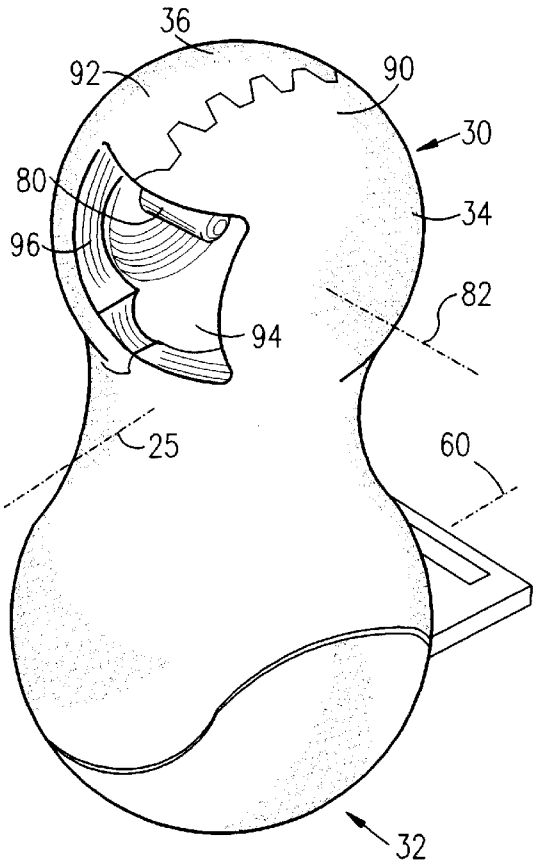

Another embodiment of lock, shown in FIGS. 9–11, is limited in its pivotability. In the embodiment of FIGS. 9–11, there are provided mutually axial protrusions 78 and 80 extending inwardly into the generally spherical volume from the interior surfaces of the lockable element enclosing portions 34 and 36. Protrusions 78 and 80 extend, when the lock is in a closed orientation, along an axis 82, which is generally perpendicular to but not intersecting with the hinge axis 25. These protrusions are intended to extend into engagement with suitable sockets, such as sockets 83 formed in hasps 84 (FIG. 11).

The lock of FIGS. 9–11 may freely pivot about axis 82. The lock of FIG. 9 may be generally identical to that of FIGS. 1–8 and is distinguished therefrom principally in that it includes protrusions 78 and 80. It is particularly suitable for locking hasps 84 having aligned apertures 83, as see in FIG. 11. The lock of FIGS. 9–11 is also preferably characterized in that the housing portions 90 and 92 thereof define cut outs 94 and 96 which together define a generally rectangular opening for accommodating the hasps 84.

Figure 14A:
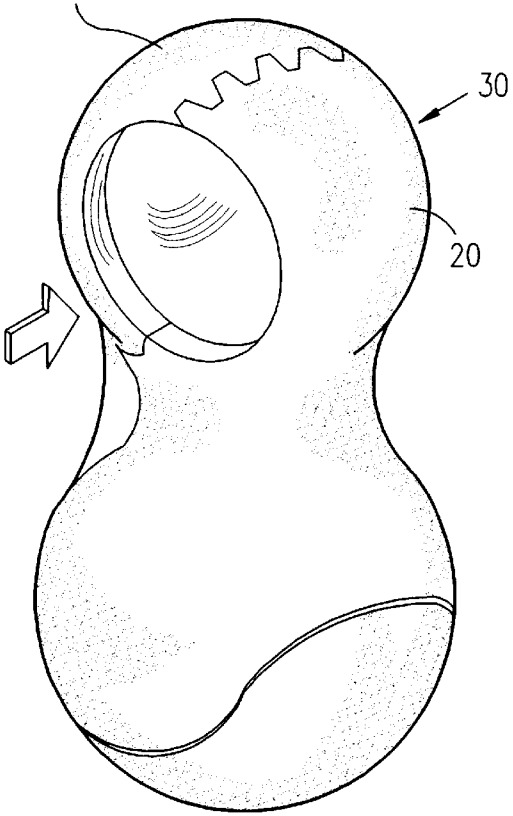
FIG. 14A and FIG. 14B are respective pictorial and sectional illustrations of the lock of FIG. 1 and FIG. 2 with another embodiment of hasp.
Figure 14B:
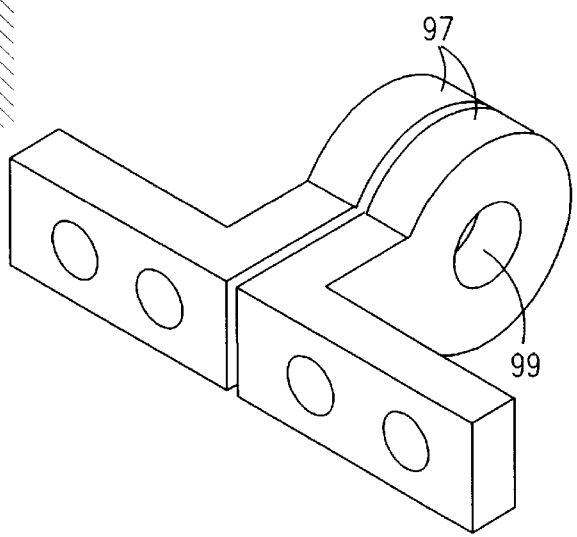
Figure 14B:
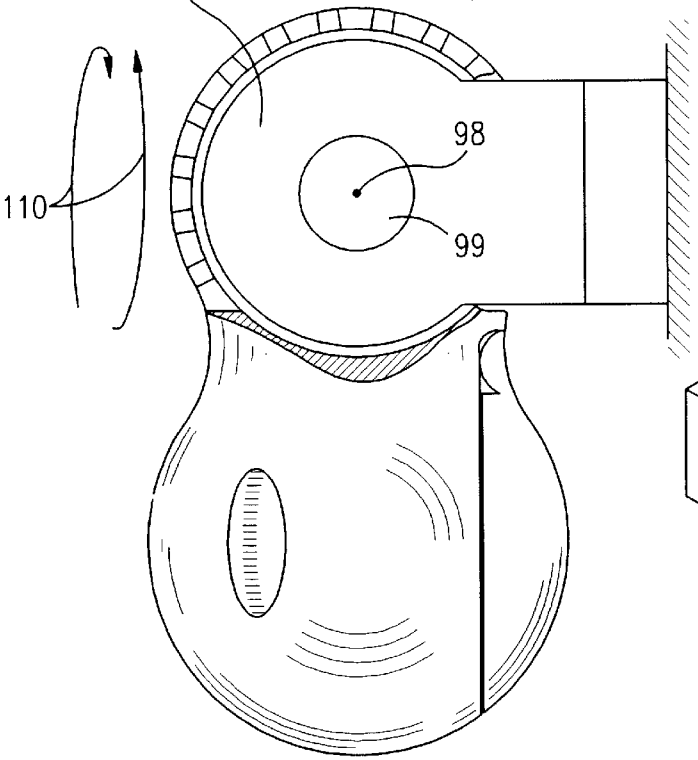

Reference is now made to FIGS. 14A and 14B, which illustrate the use of another embodiment of a novel apertured hasp 97 having a generally cylindrical configuration. As seen in FIG. 14B, the cylindrical configuration of the hasps 97, when used with a lock of the type illustrated in FIGS. 1–7, enablers the lock to pivot freely not only about the axis 98 of the apertures 99 in the hasps 97, as indicated by arrows 100 but also in other planes, as indicated by arrows 110.

Thus it may be appreciated that the free pivoting of the lock using the hasps of FIGS. 14A–14B may be the same as in the embodiment of FIGS. 1–7. The hasps of FIGS. 14A and 14B have the additional advantage, however, that they may also be locked by conventional padlocks via their apertures 99.

It will be appreciated by persons skilled in the art that the present invention is not limited by what has been particularly shown and described hereinabove. Rather, combinations and subcombinations of the various features described hereinabove and shown in the drawings as well as extensions and variations thereof, to the extent that they are not shown or suggested in the prior art, all fall within the scope of the present invention.

I claim:

1. A padlock for maintaining at least two hasps in engagement, comprising:

a two-part metal housing including first and second housing portions which are mutually hinged together so as to be pivotable between a mutually open orientation and a mutually closed orientation and a key-operated locking mechanism for selectably locking the first and second housing portions in the mutually closed orientation, the first and second housing portions each including hasp enclosing portions which are operative:

when the first and second housing portions are in the mutually closed orientation to maintain the hasps in engagement and to prevent disengagement of the first and second housing portions therefrom, and when the first and second housing portions are in the mutually open orientation to permit disengagement of the first and second housing portions from the hasps and to allow the hasps to be disengaged, wherein said first and second housing portions are configured such that when they are in the mutually closed orientation, their outer configuration generally defines first and second mutually fused spheres, one of the spheres including the hasp enclosing portions and the other of the spheres including the hinge axis and the lock cylinder.

2. A lock according to claim 1 and wherein the engagement of the hasp enclosing portions with the hasps is such that the first and second housing portions in the mutually closed orientation may be rotated about the lockable elements in multiple planes without disengagement therefrom or damage to the first and second housing portions.

3. A lock according to claim 1 and wherein the hasp enclosing portions have internally directed protrusions which engage suitable sockets formed in the hasps and thus prevent rotation of the first and second housing portions in the mutually closed orientation about the hasps.

4. A lock according to claim 1 and wherein said hasp enclosing portions each have at least one mutually engaging toothed edge surface.

5. A lock according to claim 1 and wherein the key-operated locking mechanism for selectably locking the first and second housing portions in the mutually closed orientation includes a key-operated lock cylinder.

6. A lock according to claim 5 and wherein said key-operated lock cylinder is located along an axis which is offset from a hinge axis about which the first and second housing portions are mutually rotatable.

7. A lock according to claim 5 and wherein the key-operated lock cylinder operates a cam which, when the first and second housing portions are in the mutually closed orientation is positionable by the lock cylinder in an orientation which prevents rotation of the first and second housing portions out of the mutually closed orientation.

8. A lock according to claim 1 and wherein said hasp enclosing portions are located on an opposite side of the hinge axis from the lock cylinder.

9. A lock according to claim 3 and wherein said hasp enclosing portions together define a rectangular opening to accommodate said hasps.

10. A lock according to claim 1 wherein any of said hasps is configured as a solid of revolution.

11. A lock according to claim 1 wherein any of said hasps are hemispherical.

12. A lock according to claim 1 wherein any of said hasps are unapertured.

13. A lock for maintaining at least two lockable elements in a predetermined mutual arrangement, including first and second locking members which are mutually hinged together so as to be pivotable between a mutually open orientation and a mutually closed orientation and a key-operated locking mechanism for selectably locking the first and second locking members in the mutually closed orientation, the first and second locking members each including lockable element enclosing portions which are operative:

when the first and second locking members are in the mutually closed orientation to maintain the lockable elements in the predetermined mutual arrangement and to prevent disengagement of the first and second locking members therefrom, and when the first and second locking members are in the mutually open orientation to permit disengagement of the first and second locking members from the lockable elements and to allow the lockable elements to be disengaged from the predetermined mutual arrangement, and wherein said first and second locking members are configured such that when they are in the mutually closed orientation their outer configuration generally defines first and second mutually fused spheres, one of the spheres including the lockable element enclosing portions and the other of the spheres including the hinge axis and the lock cylinder.

14. A lock according to claim 13 and wherein the engagement of the lockable element enclosing portions with the lockable elements is such that the first and second locking members in the mutually closed orientation may be rotated about the lockable elements in multiple planes without disengagement therefrom or damage to the first and second locking members.

15. A lock according to claim 13 and wherein the lockable element enclosing portions may have internally directed protrusions which engage suitable sockets formed in the lockable elements and thus prevent rotation of the first and second locking members in the mutually closed orientation about the lockable elements.

16. A lock according to claim 13 and wherein said lockable element enclosing portions each have at least one mutually engaging toothed edge surface.

17. A lock according to claim 13 and wherein the key-operated locking mechanism for selectably locking the first and second locking members in the mutually closed orientation includes a key-operated lock cylinder.

18. A lock according to claim 17 and wherein said key-operated lock cylinder is located along an axis which is offset from a hinge axis about which the first and second locking members are mutually rotatable.

19. A lock according to claim 17 and wherein the key-operated lock cylinder operates a cam which, when the first and second locking members are in the mutually closed orientation is positionable by the lock cylinder in an orientation which prevents rotation of the first and second locking members out of the mutually closed orientation.

20. A lock according to claim 13 and wherein said lockable element enclosing portions are located on an opposite side of the hinge axis from the lock cylinder.

21. A lock according to claim 13 wherein any of said hasps are unapertured.

* * * * *